US011520269B2

(12) United States Patent
Shibayama et al.

(10) Patent No.: US 11,520,269 B2
(45) Date of Patent: Dec. 6, 2022

(54) IMAGE FORMING APPARATUS

(71) Applicant: SHARP KABUSHIKI KAISHA, Sakai (JP)

(72) Inventors: Tsuyoshi Shibayama, Sakai (JP); Yuki Taniguchi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/376,019

(22) Filed: Jul. 14, 2021

(65) Prior Publication Data

US 2022/0057739 A1 Feb. 24, 2022

(30) Foreign Application Priority Data

Aug. 21, 2020 (JP) ..... JP2020-140182

(51) Int. Cl.
*B65H 43/06* (2006.01)
*G03G 15/00* (2006.01)
*B65H 43/00* (2006.01)

(52) U.S. Cl.
CPC ..... *G03G 15/6552* (2013.01); *B65H 43/00* (2013.01)

(58) Field of Classification Search
None
See application file for complete search history.

(56) References Cited

U.S. PATENT DOCUMENTS 5,419,545 A * 5/1995 Hutson ..... B65H 29/70 271/220
6,601,846 B2 * 8/2003 Saito ..... B65H 37/04 271/226
7,212,751 B2 * 5/2007 Kayama ..... B65H 31/02 399/21
7,860,412 B2 * 12/2010 Kayama ..... B65H 31/22 399/21
7,862,028 B2 * 1/2011 Nagata ..... B65H 43/06 270/32
7,865,127 B2 * 1/2011 Nakajima ..... G03G 15/6576 271/176

(Continued)

FOREIGN PATENT DOCUMENTS

JP 2007-062928 A 3/2007

*Primary Examiner* — Leslie A Nicholson, III
(74) *Attorney, Agent, or Firm* — ScienBiziP, P.C.

(57) ABSTRACT

An image forming apparatus includes a paper discharging tray and a paper detection part disposed at an upstream end of the paper discharging tray in a paper discharge direction. The paper detection part includes a base end member provided rotatably around a first axis extending in a direction perpendicular to a paper discharge direction and a tip member pivoted to the base end member to rotate around a second axis parallel to the first axis, and extending downwardly to incline toward an upstream side of the paper discharge direction in a state where the base end member is not subjected to pressure from the paper being discharged. The base end member is disposed to face a discharge opening when being at the reference position, and the image forming apparatus stops discharging paper from the discharge opening when the base end member rotates by a predetermined threshold or more with respect to the reference position.

8 Claims, 10 Drawing Sheets

(56) References Cited

U.S. PATENT DOCUMENTS

| | | | | |
|---|---|---|---|---|
| 7,959,145 | B2 * | 6/2011 | Dobashi | B65H 29/6645 270/32 |
| 8,459,643 | B2 * | 6/2013 | Cheng | B65H 43/06 271/298 |
| 8,485,523 | B2 * | 7/2013 | Kimura | B65H 33/08 271/220 |
| 11,180,337 | B2 * | 11/2021 | Kaiga | B65H 43/06 |
| 11,279,585 | B2 * | 3/2022 | Tsuji | B65H 31/26 |
| 2020/0002116 | A1 * | 1/2020 | Mizuguchi | B65H 29/125 |

* cited by examiner

IMAGE FORMING APPARATUS

BACKGROUND OF THE INVENTION

Field of the Invention

This invention relates to an image forming apparatus, in particular, for example, to an image forming apparatus including a paper discharging tray for stacking sheets on which an image is formed.

Description of the Background Art

Japanese Patent Laid Open Publication No. 2007-062928 discloses an image forming apparatus as an example of a background art. The image forming apparatus of the background art is provided with a paper discharging tray for stacking papers thereon, and the paper discharging tray is provided with a detection means including a detection lever positioned near a center of a discharging tray in a direction perpendicular to a paper discharge direction, an interlocking arm interlocking with the detection lever, and an auxiliary lever interlocking with the interlocking arm for detecting edges of papers with fully stacked.

However, the image forming apparatus of the background art has a problem that when a curl is generated, that is, in a case where a trailing edge of a paper discharged into the paper discharging tray is curved in the paper discharge direction, it is impossible to detect the curl. As a result, there is a problem that a paper stacking characteristics is deteriorated.

Therefore, a main object of the present invention is to provide a novel image forming apparatus.

Another object of the present invention is to provide an image forming apparatus capable of properly detecting a fully stacked condition of sheets discharged into a paper discharging tray or a curl generated on the sheet in the paper discharge direction, and preventing sheet stacking characteristics from being deteriorated.

SUMMARY OF THE INVENTION

In a first aspect of the invention, there is provided an image forming apparatus including: an image forming device to form an image on a sheet; a discharge opening for discharging the sheet on which the image is printed by the image forming device; a paper discharging tray on which the sheet discharged from the discharge opening is placed; a base end member provided at the discharge opening, and the base end member being rotatable around a first axis extending in a direction perpendicular to a sheet discharge direction; a tip member pivoted to the base end member to rotate around a second axis parallel to the first axis, the tip member extending downwardly to incline toward an upstream side of the sheet discharge direction in a state where the base end member is not subjected to pressure from the sheet being discharged, and the tip member coming into contact with the sheet when a height of a top surface of the sheet stacked on the paper discharging tray exceeds a predetermined height; a determiner to determine whether the base end member rotates by a predetermined threshold or more with respect to a reference position when no sheet is discharged; and a stopper to stop discharging the paper from the discharge opening in response that the determiner determines that the base end member rotates by the predetermined threshold or more with respect to the reference position. Furthermore, the base end member is disposed to face the discharge opening when being at the reference position, and the base end member and the tip member respectively rotate in response to the pressure from the sheet being discharged from the discharge opening.

In a second aspect according to the first aspect of the invention, the image forming apparatus further includes a first forcing member to force the tip member around the second axis and toward the upstream side of the sheet discharge direction.

In a third aspect according to the second aspect of the invention, when the tip member is at the reference position, a tip of the tip member is positioned at an upstream side with respect to the discharge opening in the sheet discharge direction.

In a fourth aspect according to the third aspect of the invention, the paper discharging tray includes a vertical wall surface that is formed at the upstream side with respect to the discharge opening in the sheet discharge direction, when the tip member is at the reference position, the tip of the tip member abuts on the vertical wall surface.

In a fifth aspect according to any one of the first to fourth aspects of the invention, the image forming apparatus further includes a second forcing member to force the base end member around the first axis and toward the upstream side of the sheet discharge direction.

In a sixth aspect according to any one of the first to fifth aspects of the invention, the image forming apparatus further includes a lock device that locks a posture of the tip member when the tip member is rotated by the pressure from the sheet being discharged from the discharge opening by an angle of a predetermined degrees or more.

In a seventh aspect according to the sixth aspect of the invention, the lock device releases the lock of the posture of the tip member when the base end member returns to the reference position.

In a eighth aspect according to any one of the first to seventh aspects of the invention, the image forming apparatus further includes an auxiliary member provided at an end of the discharge opening in a sheet width direction, the auxiliary member being rotatable around the first axis working with the base end member, and the auxiliary member coming into contact with the sheet when the height of the top surface of the sheet stacked on the paper discharging tray exceeds a predetermined height.

According to the present invention, it is possible to properly detect a fully stacked condition of sheets discharged into the paper discharging tray or a curl generated on the sheet in the paper discharge direction, and prevent sheet stacking characteristics from being deteriorated.

The above or other objects, features, and advantages of the present invention will be better understood by reading the following detailed description of embodiments with reference to the drawings.

DESCRIPTION OF THE PREFERRED EMBODIMENTS

DESCRIPTION OF THE PREFERRED EMBODIMENTS

First Embodiment

Figure 1:
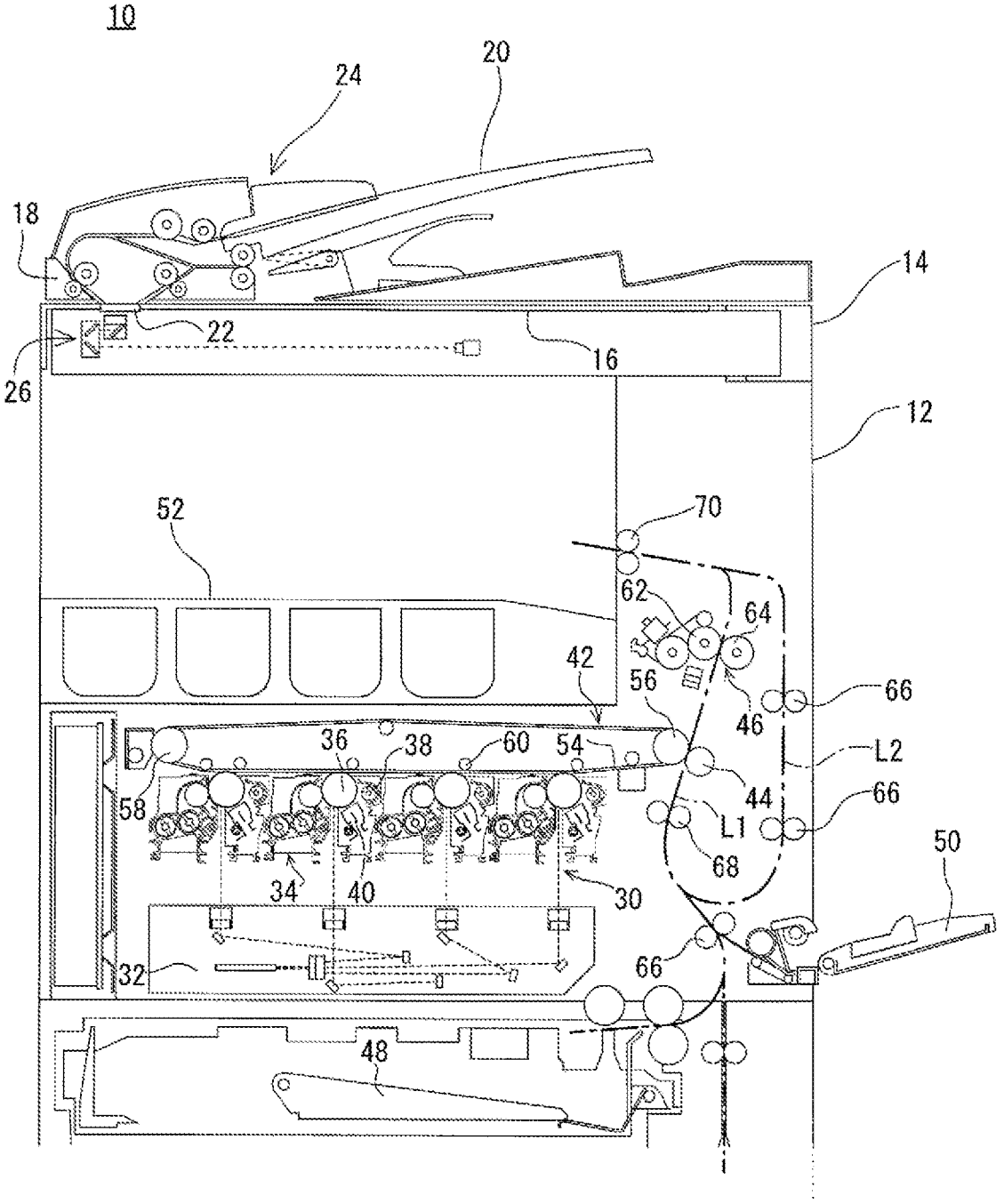
FIG. 1 is a schematically cross-sectional view illustrating an internal structure of an image forming apparatus according to a first embodiment of the present invention.

FIG. 1 is a schematically cross-sectional view illustrating an internal structure of an image forming apparatus 10 according to a first embodiment of the present invention. Referring to FIG. 1, the image forming apparatus 10 is a multifunction peripheral (MFP) having a photocopying function, a printer function, a scanner function, a facsimile function, etc., and forms a multi-color image or a monochromatic image on a recording medium (for example, a paper) by means of electrophotographic manner. However, the recording media is not limited to the paper sheets, overhead projector (OHP) films other than the paper sheets are available as the recording media, for example.

Hereinafter, throughout the specification, a left side and a right side in a horizontal direction as seen from a front side of the image forming apparatus 10 are defined as a left direction and a right direction, respectively. Furthermore, a front side (i.e., a near side) and a rear side (i.e., a depth side) of the image forming apparatus 10 in a depth direction of the image forming apparatus 10 as seen from above (or down) the image forming apparatus 10 are defined as a forward direction (also referred to as a front direction) and a backward direction (also referred to as a rear direction), respectively.

First, an outlined configuration of the image forming apparatus 10 will be described. As shown in FIG. 1, the image forming apparatus 10 includes an apparatus body 12 and an image reader 14 disposed above the apparatus body 12.

The image reader 14 includes a document laying table 16 made of a transparent material. A document pressing cover 18 is attached on the document laying table 16 with a hinge or the like in a freely open-and-close manner. The document laying cover 18 is provided with an auto document feeder (ADF) 24 which automatically feeds documents laid on a document laying tray 20 one by one to an image reading position 22. Not shown in the drawings, an operation part (such as a touch panel or operation buttons) to receive operational inputs from a user is provided on a front side of the image reader 14.

Furthermore, the image reader 14 accommodates an image reading part 26 which includes a light source, a plurality of mirrors, an imaging lens, a line sensor, etc. The image reading part 26 exposes a surface of a document to the light source, and leads a reflected light reflected from the surface of the document to the imaging lens with the plurality of mirrors. Then, the reflected light is imaged on the light receiving element of the line sensor by the imaging lens. The line sensor detects luminance or chromaticity of the reflected light imaged on the light receiving element, and generates image data based on an image depicted on the surface of the document. A CCD (Charge Coupled Device), a CIS (Contact Image Sensor) or the like is available as the line sensor.

The apparatus body 12 accommodates a control unit (not shown) which includes a CPU, a memory, an auxiliary memory unit and the like, and an image forming device 30, etc. The control unit transmits control signals to each part of the image forming apparatus 10 in response to operation instructions input from the operation part such as the touch panel, and causes the image forming apparatus 10 to perform various operations.

The image forming device 30 is provided with an exposure unit 32, a developing unit 34, a photoreceptor drum 36, a cleaner unit 38, a charging unit 40, a transfer unit 42, and a fixing unit 46, etc. The image forming device 30 forms an image on a paper transported from a paper feeding tray 48 or a manually feeding tray 50 and discharges an image-formed paper into a paper discharging tray 52. The image data, which are read by the image reading part 26 or transmitted from an external computer or the like, are used as the image data for forming the image on the paper.

The image data handled by the image forming apparatus 10 correspond to a multi-color image using four colors consisting of black (K), cyan (C), magenta (M), and yellow (Y). Therefore, the developing unit 34, the photoreceptor drum 36, the cleaner unit 38 and the charging unit 40 are provided four each so that four types of latent images corresponding to four colors are formed, and thus constitute four image stations. The four image stations are arranged in a horizontal line along a traveling direction (i.e., a left-right direction) of a surface of an intermediate transfer belt 54.

The photoreceptor drum 36 is an image carrier in which a photosensitive layer is formed on a surface of a cylindrical base body having conductivity, and the charging unit 40 is a member to charge the surface of the photoreceptor drum 36 to a predetermined potential. Furthermore, the exposure unit 32 is configured as a laser scanning unit including a laser diode (LD) and a polygon mirror, etc., and located below the photoreceptor drum 36. The exposure unit 32 exposes the surface of the charged photoreceptor drum 36 to form on the surface of the photoreceptor drum 36 an electrostatic latent image in accordance with the image data. The developing unit 34 visualizes the electrostatic latent image formed on the photoreceptor drum 36 with toners of four colors (i.e., Y, M, C, and K). Furthermore, the cleaner unit 38 removes a residual toner remaining on the surface of the photoreceptor drum 36 after performing the development and image transfer.

The transfer unit 42 is provided with the intermediate transfer belt 54, a driving roller 56, a driven roller 58, four intermediate transfer rollers 60 and a transfer roller (also referred to as a secondary transfer roller) 44, and disposed above the photoreceptor drums 36 in the image stations.

The intermediate transfer belt 54 is an endless belt having flexibility and is made of a synthetic resin or rubber, etc. in which conductive materials such as a carbon black are blended as appropriate. The intermediate transfer belt 54 is suspended by the driving roller 56 and the driven roller 58, and is located so that an outer peripheral surface of the intermediate transfer belt 54 comes into contact with an outer peripheral surface of the photoreceptor drum 36. The intermediate transfer belt 54 circulates in a predetermined direction with a rotary drive of the driving roller 56.

The driving roller 56 is provided rotatably around an axis of the driving roller 56 with a drive unit (not shown). The driven roller 58 rotates with a circulation of the intermediate transfer belt 54 as well as applies a certain tension to the intermediate transfer belt 54 to prevent the intermediate transfer belt 54 from loosening.

The intermediate transfer rollers 60 are arranged at positions in which the intermediate transfer rollers 60 face the photoreceptor drums 36 across the intermediate transfer belt 54, respectively. During image forming process, a transfer electric field is formed between the photoreceptor drum 36 and the intermediate transfer belt 54 by applying a predetermined voltage (i.e., a primary transfer voltage) to the intermediate transfer roller 60. By the action of the transfer electric field, a toner image formed on the outer peripheral surface of the photoreceptor drum 36 in each of the image stations is transferred to the outer peripheral surface of the intermediate transfer belt 54.

A secondary transfer roller 44 is provided to press the intermediate transfer belt 54 between the secondary transfer roller 44 and the driving roller 56. During image forming process, the transfer electric field is formed between the intermediate transfer belt 54 and the secondary transfer roller 44 by applying a predetermined voltage (i.e., a secondary transfer voltage) to the secondary transfer roller 44. By the action of the transfer electric field, the toner image formed on the outer peripheral surface of the intermediate transfer belt 54 is transferred (i.e., secondarily transferred) to a paper while the paper passes through a transfer nip area between the intermediate transfer belt 54 and the secondary transfer roller 44.

Returning to FIG. 1, the fixing unit 46 is provided with a heating roller 62 and a pressure roller 64. The fixing unit 46 is disposed above the secondary transfer roller 44. The heating roller 62 is set to be a predetermined fixing temperature, and as the paper passes through the nip area between the heating roller 62 and the pressure roller 64, the toner image transferred to the paper is heated and pressed, so that the toner image is thermally fixed to the paper.

Inside the apparatus body 12, there is formed a first paper transport path L1 for transporting the paper from the paper feeding tray 48 or the manually feeding tray 50 to the paper discharging tray 52 via a resist roller 68, the secondary transfer roller 44, and the fixing unit 46. Furthermore, there is also formed a second paper transport path L2 for returning the paper passing through the fixing unit 46 after a front side of the pater is printed to the first paper transport path L1 at the upstream side of the secondary transfer roller 44 in a paper transport direction in order to perform a duplex printing on the paper. In the first paper transport path L1 and the second paper transport path L2, there are provided a plurality of transport rollers 66 to provide an auxiliary propulsion to the paper as appropriate.

The resist roller 68, which is also referred to as a paper stop roller (i.e., PS roller), transports the paper at the same speed as a process speed at which the image forming device 30 performs the image formation process on the paper. For example, the resist roller 68 stands by (or pauses) while nipping the transported paper with the transport rollers 66, and then starts transporting the paper in synchronization with the transfer unit 42.

In case of performing a simplex printing in the image forming apparatus 10, the paper is led one by one from the paper feeding tray 48 or the manually feeding tray 50 into the first paper transport path L1, and then transported to the resist roller 68 with the transport rollers 66. The resist roller 68 transports the paper to the secondary transfer roller 44 (i.e., a secondary transfer nip part) at a timing when a tip of the paper and a tip of the image information on the intermediate transfer belt 54 are aligned each other, and the toner image is transferred on the paper. Then, an unfixed toner on the paper is thermally fixed by passing through the fixing unit 46 (i.e., a fixing nip part), and the paper is discharged onto the paper discharging tray 52 via the paper discharging roller 70 in the vicinity of the paper discharging tray 52.

On the other hand, in case of performing a duplex printing, when a trailing edge of the paper passing through the fixing unit 46 after the front side of the pater is printed reaches the paper discharging roller 70, the paper reversely travels and is led to the second paper transport path L2 by reversely rotating the transport rollers 66. The paper led to the second paper transport path L2 is transported through the second paper transport path L2 with the transport rollers 66, and then led to the first paper transport path L1 at the upstream side of the resist roller 68 in a paper transporting direction. At this time, as the front and back surfaces of the paper are inverted, a printing process is performed on the back side of the paper by passing through the resist roller 68, the secondary transfer roller 44, and the fixing unit 46 in order.

Figure 2:
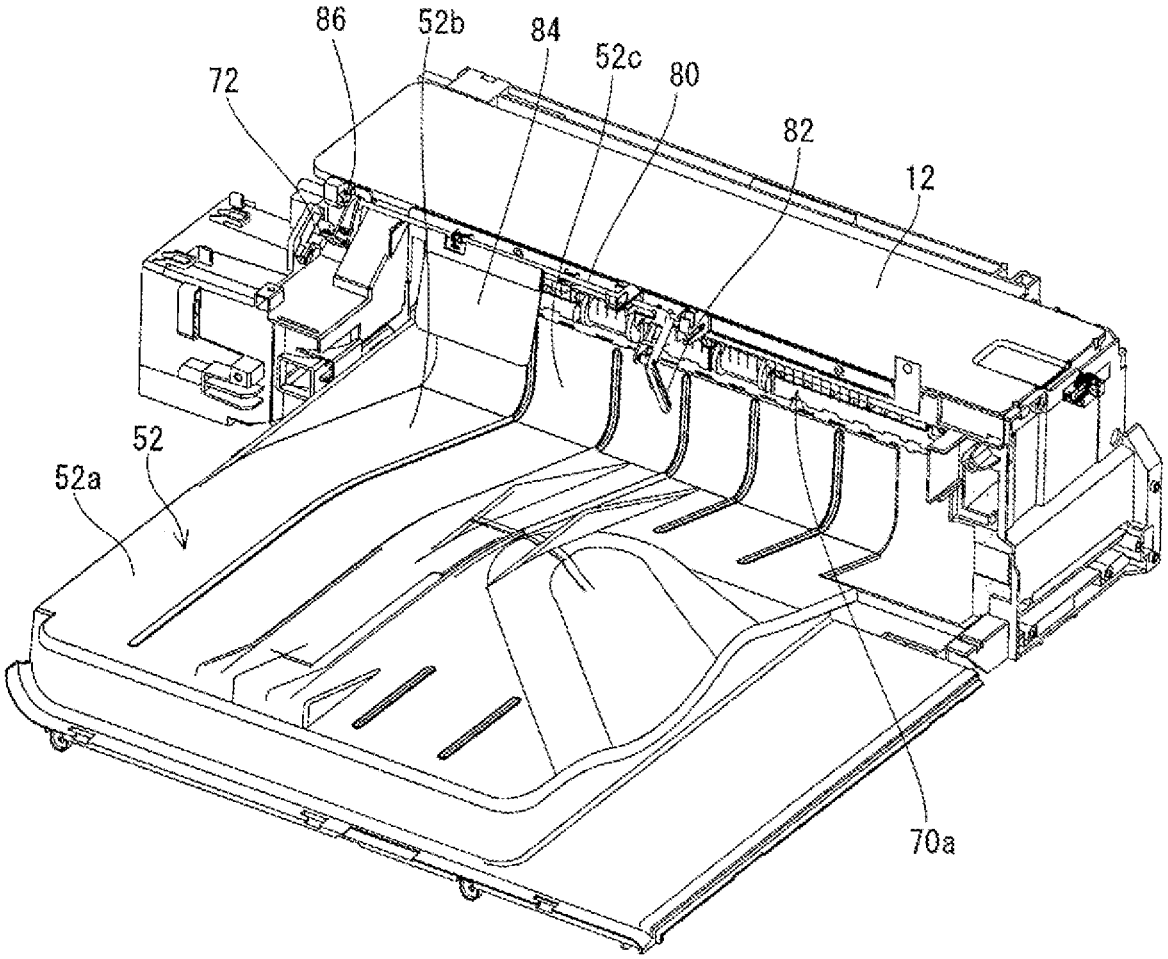
FIG. 2 is a perspective view illustrating a paper discharging tray and a peripheral configuration thereof.
Figure 3:
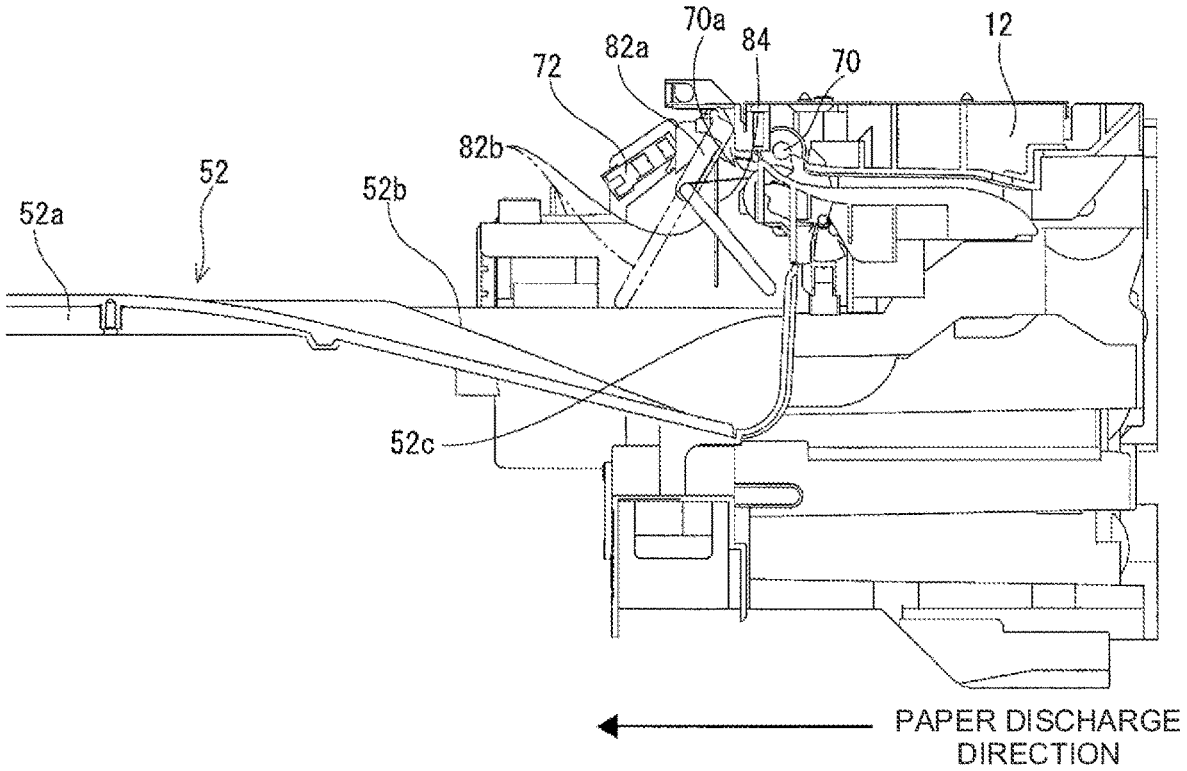
FIG. 3 is a front view of the paper discharging tray with no papers and a peripheral configuration thereof.
Figure 4:
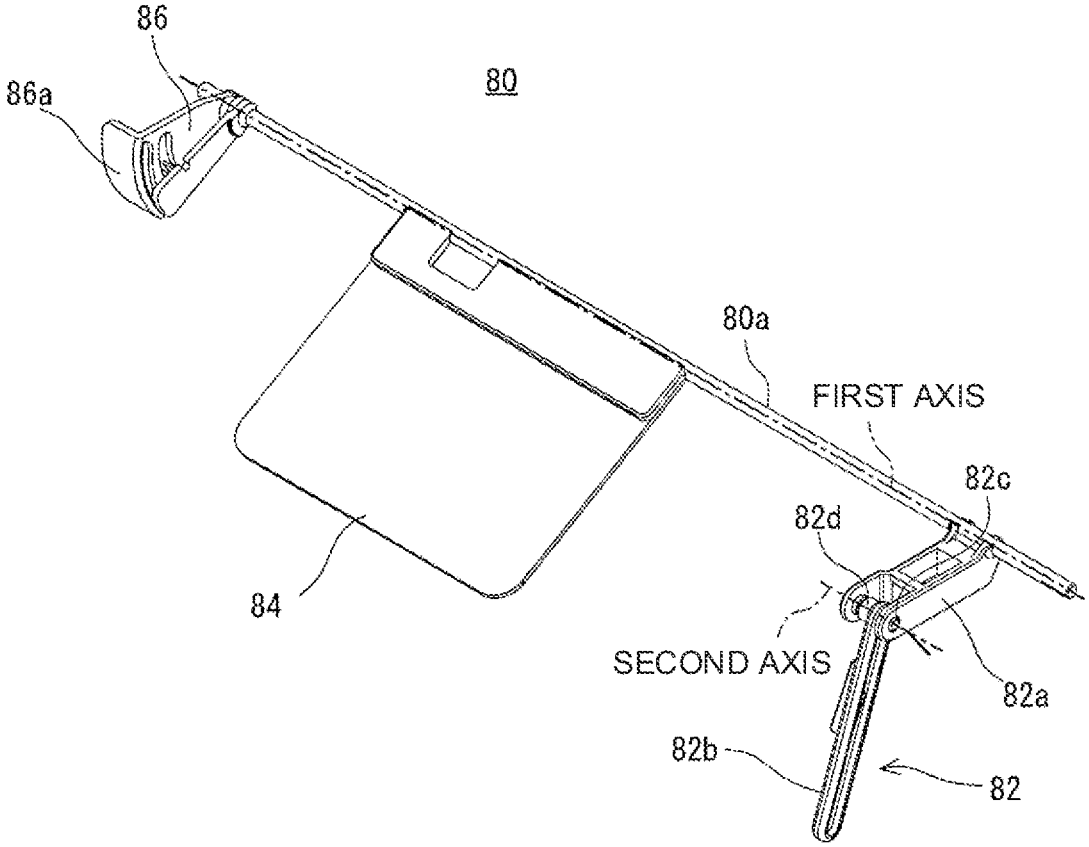
FIG. 4 is a perspective view illustrating a configuration of a paper detection part.

Now, the specific configuration of the paper discharging tray 52 according to the present embodiment and a peripheral thereof will be described below with reference to the drawings. As shown in FIGS. 2 to 4, the paper discharging tray 52 includes a horizontal surface 52*a*, an inclined surface 52*b* leading to the horizontal surface 52*a*, and a vertical wall surface 52*c*. The horizontal surface 52*a* is located at a downstream side of the paper discharging tray 52 in the paper discharge direction (or a sheet discharge direction), and the inclined surface 52*b* is located at an upstream side of the paper discharging tray 52 in the paper discharge direction. In addition, the inclined surface 52*b* has a downward slope toward the upstream side in the paper discharge direction. The vertical wall surface 52*c* extends upwardly from an end of the upstream side of the inclined surface 52*b* in the paper discharge direction, and is located at an upstream side with respect to a discharge opening 70*a* in the paper discharge direction.

the paper discharging tray 52 slides down by its own weight the inclined surface 52*b* toward an upstream side (i.e., a discharge opening 70*a* side) in the paper discharge direction, and is brought into contact with the upstream end (i.e., the vertical wall surface 52*c*) of the paper discharging tray 52 in the paper discharge direction. In other words, the trailing edge (i.e., an end of the upstream side in the paper discharge direction) of the paper placed on the paper discharging tray 52 is positioned at the end of the upstream side of the paper discharging tray 52 in the paper discharge direction. Meanwhile, there is provided a plurality of ribs leading in the paper discharge direction on an upper surface of the paper discharging tray 52 (i.e., an upper surface of the horizontal surface 52*a* and an upper surface of the inclined surface 52*b*), and upper surfaces of these ribs may function as a paper laying surface.

The image forming apparatus 10 is provided with a paper detection part 80 for detecting a condition of the paper on the paper discharging tray 52. As shown in FIGS. 2 to 4, the paper detection part 80 is provided in the vicinity of the discharge opening 70*a* (i.e., at the end of the upstream side of the paper discharging tray 52 in the paper discharge direction), and includes a shaft member 80*a*, a first detection part 82, a second detection part (as an auxiliary member) 84, and a shielding section 86.

The shaft member 80*a* is a columnar or cylindrical member, and is rotatably pivoted to the apparatus body 12. Furthermore, an axis of the shaft member 80*a* (also referred to as a first axis) extends in a direction, which is perpendicular to the paper discharge direction and along a discharge opening 70*a*. Furthermore, the first axis is substantially parallel to a surface of the paper discharged from the discharge opening 70*a*. Moreover, each of the first detection part 82, the second detection part 84, and the shielding section 86 is attached (e.g., fixed) to the shaft member 80*a*. Therefore, each of the first detection part 82, the second detection part 84, and the shielding section 86 integrally rotates around the first axis working with the shaft member 80*a* when the shaft member 80*a* rotates.

In addition, the first detection part 82, the second detection part 84, and the shielding section 86 are located at a downstream side with respect to the discharge opening 70*a* in the paper discharge direction. Furthermore, not shown in the drawings, between the apparatus body 12 and the shaft member 80*a*, there is provided a second forcing member (e.g., a torsion spring) to force the shaft member 80*a* toward an upstream side in the paper discharge direction (i.e., toward a direction closer to the discharge opening 70*a*) so that the first detection part 82, the second detection part 84, and the shielding section 86 rotate around the first axis. However, the force of the second forcing member is set to the extent that it does not prevent the paper from being discharged from the discharge opening 70*a*.

Hereinafter, in a state where the first detection section 82, the second detection section 84, and the shielding section 86 receive no pressure from the paper being discharged from the discharge opening 70*a* as well as do not abut on (or come into contact with) the upper surface of the paper placed on the paper discharging tray 52, it is referred that the first detection section 82, the second detection section 84, and the shielding section 86 is respectively arranged in a predetermined aspect (i.e., at a reference position).

The first detection part 82 includes a base end member 82*a*, a tip member 82*b*, a shaft member 82*c*, and a first forcing member 82*d*, and is disposed at a substantial center of the paper discharging tray 52 in the front-back direction (i.e., a paper width direction).

The base end member 82*a* is a rod-like member whose one end is attached to the shaft member 80*a*. When being at the reference position, the base end member 82*a* takes a posture that gradually heads down as it goes toward a downstream side in the paper discharge direction (i.e., gradually heads up as it goes toward an upstream side in the paper discharge direction).

Furthermore, as shown in FIG. 3, when being at the reference position, the base end member 82*a* is disposed to face the discharge opening 70*a*. Accordingly, when the paper is discharged from the discharge opening 70*a*, the leading edge of the paper (an end of a downstream side of the paper in the paper discharge direction) comes into contact with the base end member 82*a*.

As shown in FIGS. 2 to 4, the tip member 82*b* is a rod-like member whose one end is rotatably pivoted to the base end member 82*a*. Specifically, one end of the tip member 82*b* is pivoted to a shaft member 82*c* provided at the other end portion of the base end member 82*a*. An axis of the shaft member 82*c* (referred to as a second axis) extends in a direction, which is perpendicular to the paper discharge direction and along a discharge opening 70*a*. In other words, the second axis is substantially parallel to the first axis. Namely, the tip member 82*b* is provided to be rotatable around the second axis which is substantially parallel to the first axis.

Furthermore, when being at the reference position, the tip member 82*b* takes a posture that gradually heads down as it goes toward a downstream side in the paper discharge direction (i.e., gradually heads up as it goes toward an upstream side in the paper discharge direction). Moreover, when being at the reference position, the other end (i.e., a tip potion) of the tip member 82*b* is located at an upstream side with respect to the discharge opening 70*a* in the paper discharge direction.

As described above, the base end member 82*a* and the tip member 82*b* are bent at a predetermined angle around the shaft member 82*c* (second axis) as seen from the front (or back) side.

The first forcing member 82*d* is a torsion spring (e.g., a twist spring, a torsion coil spring, etc.) which is wound around the shaft member 82*c*, and forces the tip member 82*b* to rotate around the second axis toward the upstream side in the paper discharge direction (i.e., in a direction approaching the discharge opening 70*a*). However, the force of the first forcing member 82*d* is set to the extent that it does not prevent the paper from being discharged from the discharge opening 70*a*.

As shown in FIGS. 2 and 4, the second detection section 84 is a plate-like member and is disposed at one end of the paper discharging tray 52 in the front-back direction (i.e., the paper width direction). When being at the reference position, the second detection section 84 is located so as to gradually heads down as it goes toward the downstream side in the paper discharge direction, that is, located diagonally in the same direction as the base end member 82*a*. Furthermore, the second detection section 84 is provided to correspond to each of end positions in the width direction of various sizes of papers used in the image forming apparatus 10. Specifically, in the front-to-back direction (i.e., in a paper width direction) of the second detection section 84, there is provided the second detection section 84 so as to cover a range from a position of the width direction end of the smallest-sized paper used in the image forming apparatus 10 to a position of the width direction end of the largest-sized paper used in the image forming apparatus 10.

Furthermore, the image forming apparatus 10 is provided with a detection sensor 72 that detects position information (e.g., a rotation angle) of the base end member 82*a* (or the shaft member 80*a*). The detection sensor 72 is, for example, a photo sensor having a light emitting element and a light receiving element, and is connected to the control unit (CPU). In one case where the rotation angle of the base end member 82*a* exceeds a predetermined threshold relative to the reference position, a shielding wall 86*a* of the shielding section 86 is positioned between the light emitting element and the light receiving element, so that light from the light emitting element is blocked by the shielding wall 86*a* and thus not received by the light receiving element. On the other hand, in another case where the base end member 82*a* is positioned at the reference position or the rotation angle of the base end member 82*a* does not exceed the predetermined threshold relative to the reference position, the light from the light emitting element is not blocked and thus received by the light receiving element. The detection sensor 72 outputs to the CPU a signal indicating whether the light from the light-emitting element is received by the light-receiving element, and the CPU detects a full stack (or full) of papers or a curl generated on the paper in the paper discharge direction in response to the output signal of the detection sensor 72. Furthermore, when the CPU detects the full stack of papers or the curl generated on the paper in the paper discharge direction, it determines that a condition to stop transporting the paper is met and then stops discharging the paper (i.e., transporting the paper through the paper transport paths L1 and L2).

Next, in an event that the paper is discharged from the discharge opening 70*a* in the image forming apparatus 10 according to the present embodiment, an operation of the paper detection part 80 will be described below.

First, when the paper is discharged from the discharge opening 70*a*, the leading edge of the paper abuts on the base end member 82*a*. At this time, as the force of the second forcing member is set to the extend that it does not prevent the paper from being discharged from the discharge opening 70*a*, when the leading edge of the paper abuts on the base end member 82*a*, the base end member 82*a* rotates toward the downstream side in the paper discharge direction (i.e., a direction away from the discharge opening 70*a*) against the force from the second forcing member. When the base end member 82*a* rotates by a predetermined angle toward the downstream side in the paper discharge direction, the leading edge of the paper abuts on the tip member 82*b*. At this time, as the force of the first forcing member 82*d* is also set to the extend that it does not prevent the paper from being discharged from the discharge opening 70*a*, the tip member 82*b* rotates toward the downstream side in the paper discharge direction (i.e., a direction away from the discharge opening 70*a*) against the force from the first forcing member 82*d*.

Figure 5:
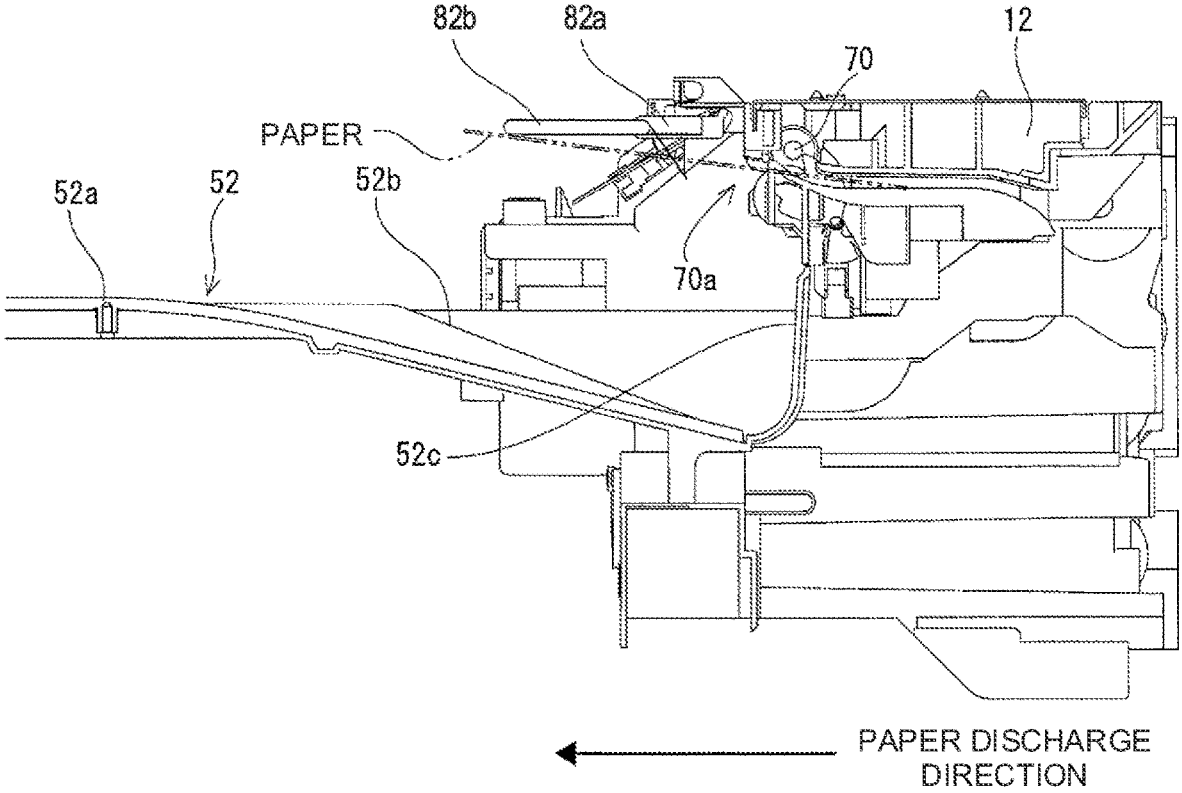
FIG. 5 is a front view illustrating the paper detection part when the paper is discharged and a peripheral configuration thereof.

As shown in FIG. 5, the entire the base end member 82*a* and the tip member 82*b* is located at a position above the surface of the paper being discharged from the discharge opening 70*a* (hereinafter, referred to as a paper through position). When being at the paper through position, a longitudinal direction (i.e., an extension direction) of the base end member 82*a* and a longitudinal direction (i.e., an extension direction) of the tip member 82*b* are identical. Namely, the base end member 82*a* and the tip member 82*b* are aligned on a substantial straight line.

Here, since the force from the second forcing member is acting on the base end member 82*a*, the base end member 82*a* never rotates excessively in a direction opposite to a direction of the force from the second forcing member. Similarly, since the force from the first forcing member 82*d* is acting on the tip member 82*b*, the tip member 82*b* never rotates excessively in a direction opposite to a direction of the force from the first forcing member 82*d*. Optionally, there may be provided a limiting part (also referred to as a base end member limiting part) that physically limits the base end member 82*a* to rotate in excess of a predetermined angle in the direction opposite to the direction of the force from the second forcing member, and a limiting part (also referred to as a tip member limiting part) that physically limits the tip member 82*b* to rotate in excess of a predetermined angle in the direction opposite to the direction of the force from the first forcing member 82*d*, respectively.

When the trailing edge of the paper passes through the paper detection part 80 (specifically, a tip of the tip member 82*b*), the base end member 82*a* and the tip member 82*b* are forced to return from the paper-through position to the reference position by the force from the first forcing member 82*d* and the force from the second forcing member. In the case where the base end member 82*a* and the tip member 82*b* return from the paper through position to the reference position, if the tip of the tip member 82*b* does not abut on (or come into contact with) the paper stacked on the paper discharging tray 52, the base end member 82*a* and the tip member 82*b* return to the reference position (see FIG. 3).

Figure 6:
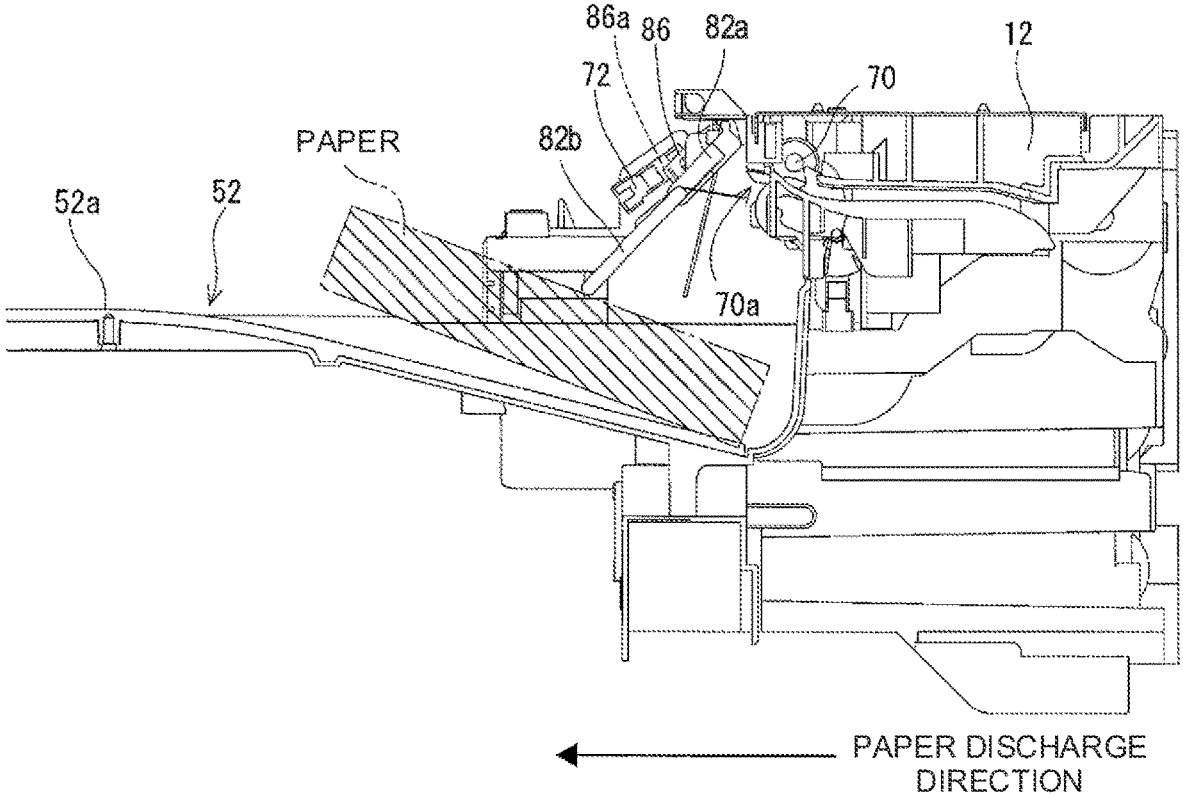
FIG. 6 is a front view illustrating the paper detection part when the papers are fully stacked and a peripheral configuration thereof.

On the other hand, as shown in FIG. 6, in a state (fully stacked state) where higher number of papers than a predetermined number of papers (e.g., the maximum number of papers that can be stacked) are stacked on the paper discharging tray 52, when the base end member 82*a* and the tip member 82*b* return from the paper through position to the reference position, the tip of the tip member 82*b* comes into contact with the paper, so that the base end member 82*a* and the tip member 82*b* are suspended at a predetermined position between the paper through position and the reference position. In other words, the base end member 82*a* and the tip member 82*b* do not completely return to the reference position. At this time, as the base end member 82*a* is suspended with rotating by a predetermined angle from the reference position toward the downstream side in the paper discharge direction, the shielding wall 86*a* of the shielding section 86 is positioned between the light emitting element and the light receiving element, so that it is determined that the condition to stop transporting the paper is met, and thus an operation of discharging the paper is stopped.

Figure 7:
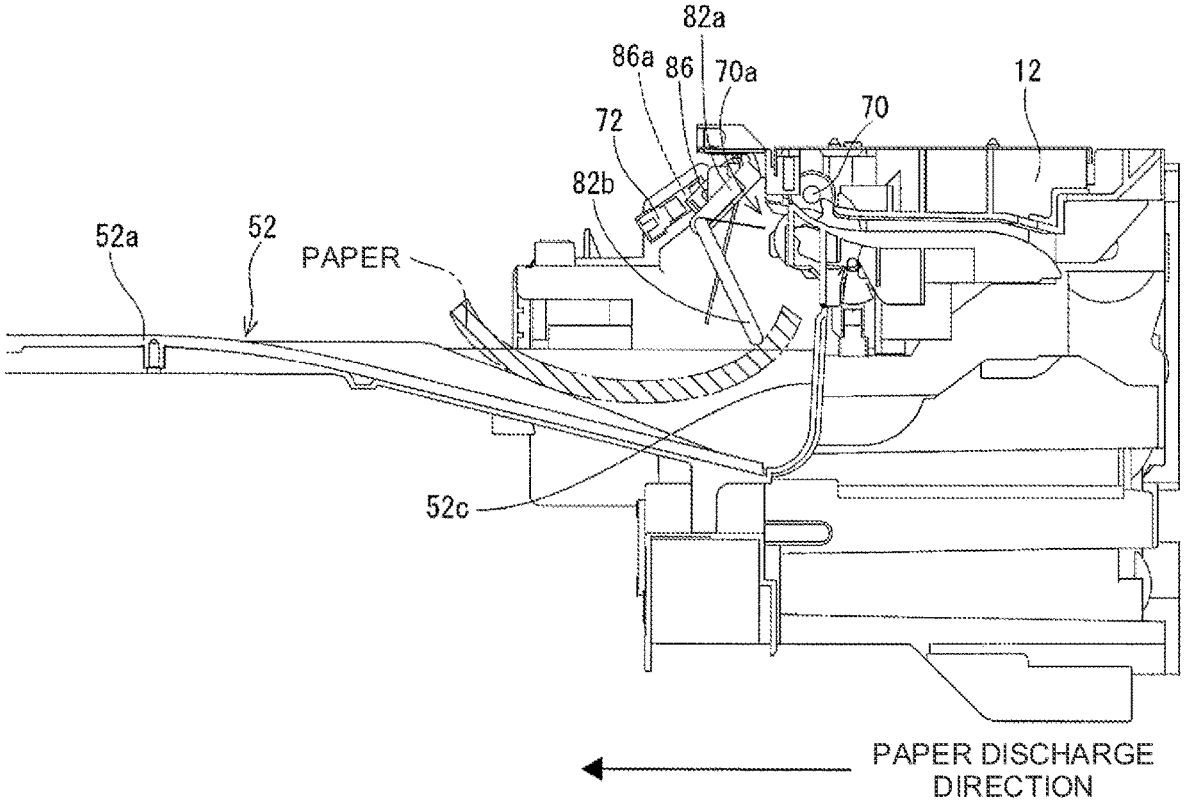
FIG. 7 is a front view illustrating the paper detection part when a curl is generated in a paper discharge direction and a peripheral configuration thereof.

Furthermore, as shown in FIG. 7, even if the number of the stacked papers lie within the tolerance (i.e., not a fully stacked state), in such a case that the trailing edge of the paper is curved and thus so-called curl is generated in the paper discharge direction (i.e., a paper discharge direction curl generation state), the tip of the tip member 82*b* comes into contact with the paper, so that the base end member 82*a* and the tip member 82*b* are suspended at a predetermined position between the paper through position and the reference position. Therefore, as the base end member 82*a* is suspended with rotating by the predetermined angle from the reference position toward the downstream side in the paper discharge direction, so that it is determined that the condition to stop transporting the paper is met and thus the operation of discharging the paper is stopped, similarly to the fully stacked state.

According to the present embodiment, it is possible to properly detect a fully-stacked condition of the papers on the paper discharging tray 52 or a curl generated on the papers in the paper discharge direction, and prevent a paper stacking characteristics from being deteriorated.

Furthermore, according to the present embodiment, as there is provided the first forcing member 82*d* to force the tip member 82*b* toward the upstream side in the paper discharge direction, it is possible to completely return the tip member 82*b* to the reference position when the condition to stop transporting the paper is not met, for example the papers are not fully stacked or no curl generated on the paper in the paper discharge direction, so that erroneous detection can be prevented.

Furthermore, according to the present embodiment, as there is provided the second forcing member to force the shaft member 80*a* and the base end member 82*a* attached thereto toward the upstream side in the paper discharge direction, it is possible to completely return the base end member 82*a* to the reference position when the condition to stop transporting the paper is not met, so that the erroneous detection can be prevented.

Furthermore, according to the present embodiment, when being at the reference position, as the tip of the tip member 82*b* is positioned at the upstream side with respect to the discharge opening 70*a* in the paper discharge direction, it is possible to precisely detect the curl generated on the trailing edge of the paper.

In the present embodiment, although the tip of the tip member 82*b* is apart from the vertical wall surface 52 when being at the reference position, it may abut on the vertical wall surface 52*c*. In this case, the tip of the tip member 82*b* when being at the reference position may be positioned at the upstream side with respect to a rotation axis of the paper discharging roller 70 in the paper discharge direction. By configuring in this way, it is possible to more precisely detect the curl generated on the trailing edge of the paper.

Figure 8:
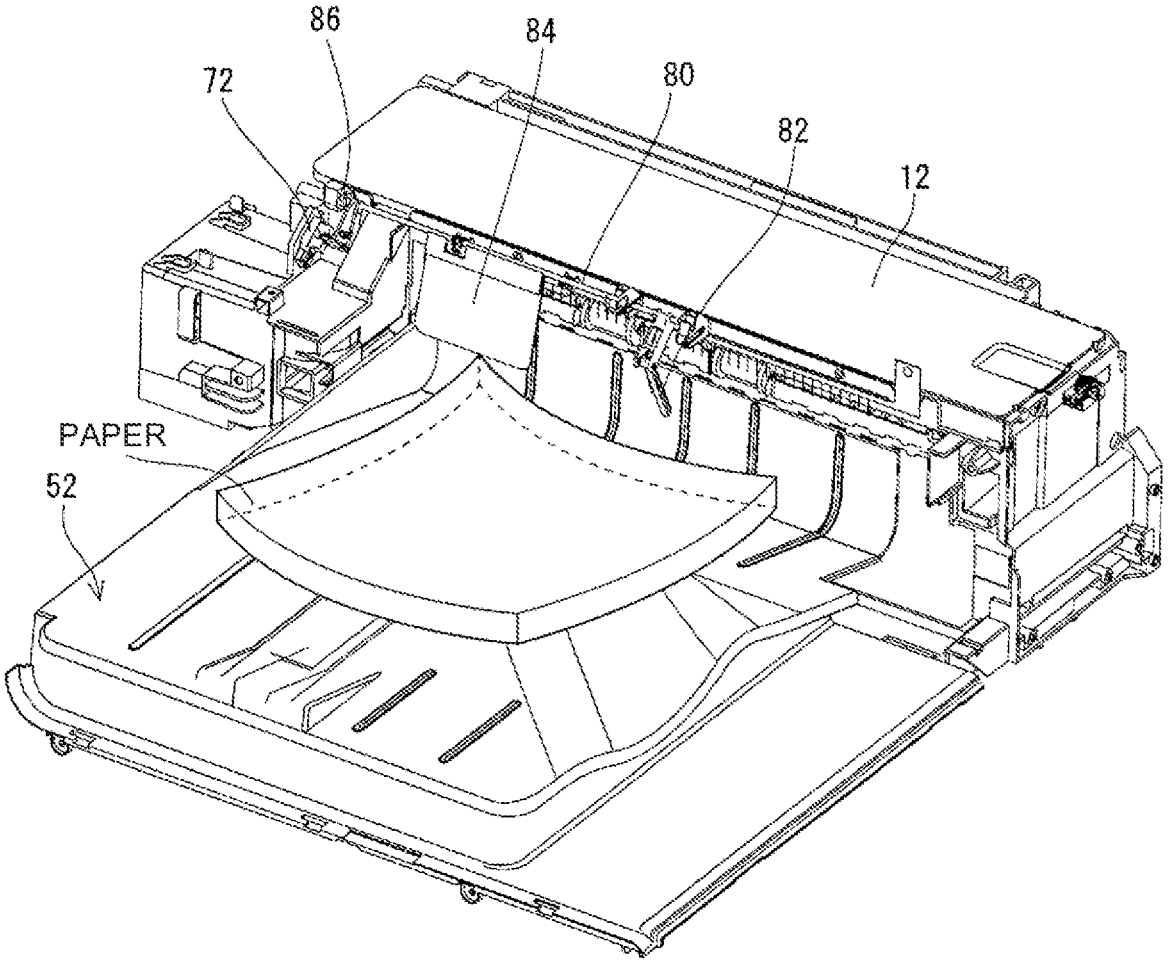
FIG. 8 is a perspective view illustrating the paper detection part when a curl is generated in a paper width direction and a peripheral configuration thereof.

Furthermore, as shown in FIG. 8, even if the number of stacked papers lies within the tolerance, in a state where the curl, which curves an end portion in a width direction of the paper, is generated (referred to as a paper width direction curls generation state), the end portion in the width direction of the paper comes into contact with the second detection part 84, and thus the second detection part 84 is pushed up. As described above, since each of the first detection part 82, the second detection part 84, and the shielding section 86 integrally rotates around the first axis working with the shaft member 80*a*, when the second detection part 84 is pushed up by the paper, the base end member 82*a* rotates by a predetermined angle toward the downstream side with respect to the reference position in the paper discharge direction. As a result, it is determined that the condition to stop transporting the paper is met, and thus the operation of discharging the paper is stopped. Therefore, it is possible to properly detect the curls generated in the paper width direction and prevent the paper stacking characteristics from being deteriorated.

Second Embodiment

Since the image forming apparatus 10 according to the second embodiment is identical to the image forming apparatus 10 according to the first embodiment except for including a lock device for locking the posture of the tip member 82*b*, there will be described only different points from the first embodiment to avoid overlapping descriptions.

Figure 9:
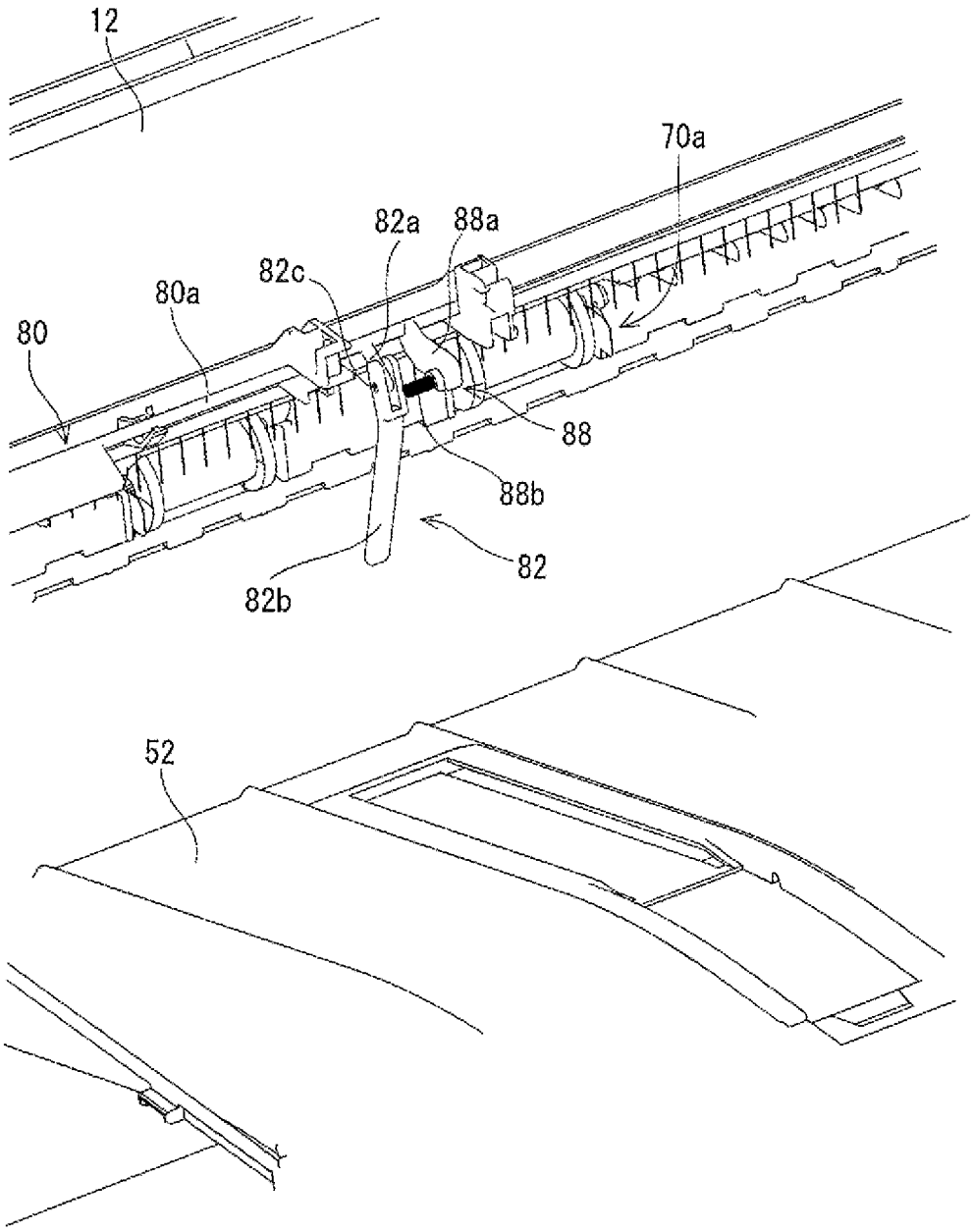
FIG. 9 is a perspective view illustrating the paper detection part according to a second embodiment of the present invention and a peripheral configuration thereof.

As shown in FIG. 9, the paper detection section 80 according to the second embodiment is provided with a lock device 88. The lock device 88 includes a protrusion 88*a* and an elastic part 88*b*. The protrusion 88*a* is disposed adjacent to the first detection part 82 (or a base end member 82*a*) and protrudes from the shaft member 80*a* toward the paper discharge direction (i.e., a side of the paper discharging tray 52). Specifically, the protrusion 88*a* extends from the shaft member 80*a* in the same direction as the first detection part 82 (or the base end member 82*a*).

The elastic part 88*b* is provided at a tip of the protrusion 88*a* (i.e., at the end in the paper discharge direction). In addition, the elastic part 88*b* is provided so that a part thereof overlaps the first detection part 82 (or the tip member 82*b*) in the front-back direction (i.e., an axial direction of the shaft member 80*a* or an axial direction of the shaft member 82*c*). Furthermore, the elastic part 88*b* is provided between the first detection part 82 (or the tip member 82*b*) when positioned at the reference position and the first detection part 82 (or the tip member 82*b*) when positioned at the paper-through position.

Therefore, when the first detection part 82 (or the tip member 82*b*) is rotated between the reference position and the paper through position, the first detection part 82 (or the tip member 82*b*) abuts on the elastic part 88*b*, so that the rotation of the first detection part 82 (or the tip member 82*b*) is disrupted by the elastic part 88*b*.

Figure 10:
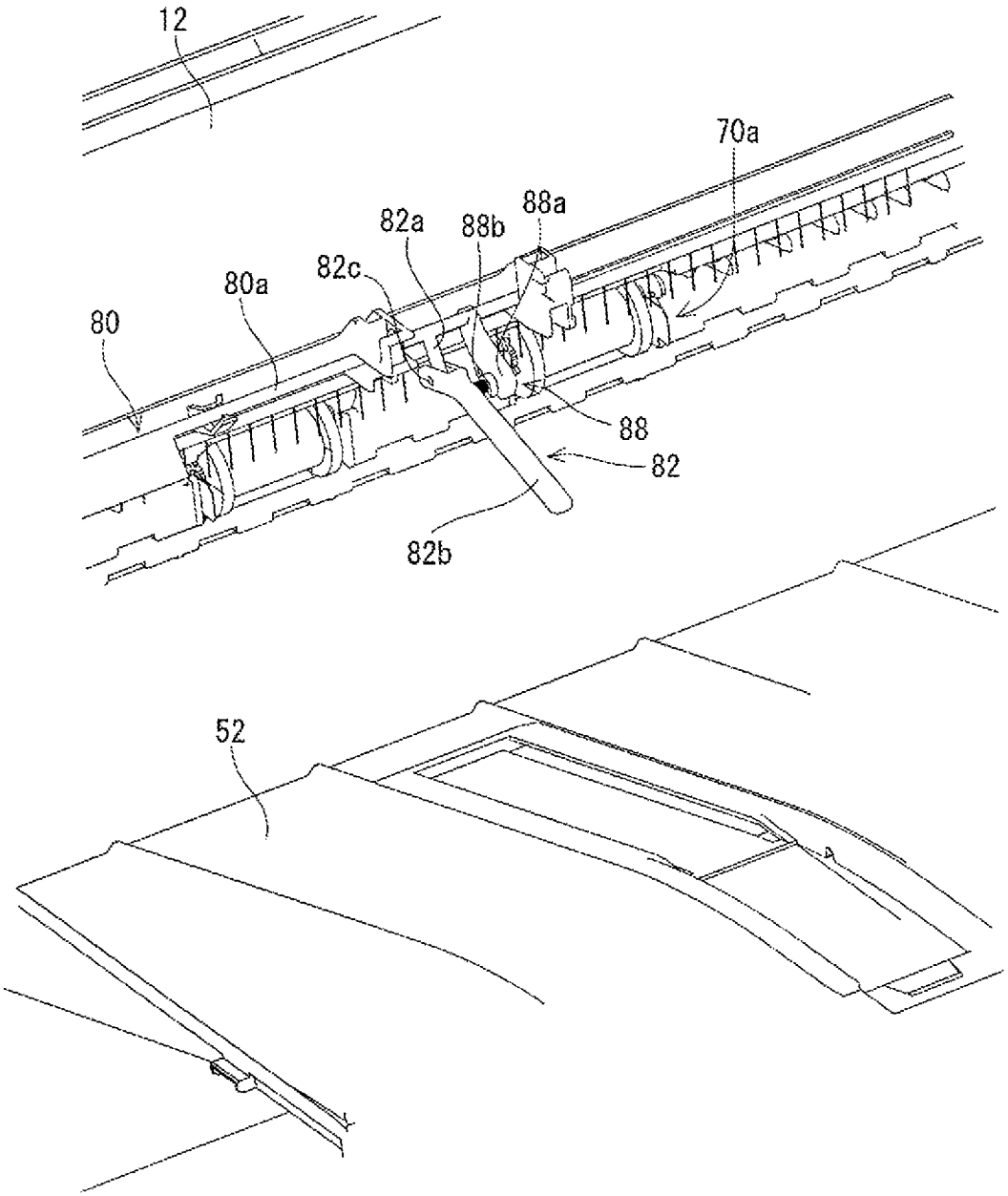
FIG. 10 is a perspective view illustrating the paper detection part according to the second embodiment of the present invention when the paper is discharged and a peripheral configuration thereof.

However, the elastic part 88*b* is deformed into such a shape that the elastic part 88*b* does not disrupt the rotation of the first detection part 82 (or the tip member 82*b*) when it is subjected to pressure equivalent to pressure applied by the paper being discharged from the discharge opening 70*a*. Therefore, as shown in FIG. 10, the first detection section 82 (or the tip member 82*b*) gets free from the elastic part 88*b* and rotates from the reference position to the paper-through position.

On the other hand, the elastic part 88*b* does not significantly deform when it is subjected to pressure equivalent to pressure applied by both the weight of the tip member 82*b* and the force from the first forcing member 82*d*. Accordingly, the rotation of the first detection section 82 (or the tip member 82*b*) is disrupted. Therefore, when the first detection part 82 (or the tip member 82*b*) once gets free from the elastic part 88*b* and then is positioned at a position close to the paper-through position with respect to the elastic part 88*b*, the first detection part 82 (or the tip member 82*b*) comes to be supported by the elastic part 88*b*. In other words, the posture of the tip member 82*b* is locked. At this time, since the first detection part 82 (or the tip member 82*b*) is positioned above the upper surface of the paper discharged from the discharge opening 70*a*, the weight of the first detection part 82 (or the tip member 82*b*) by itself and the force from the first forcing member 82*d* never act on the paper being discharged from the discharge opening 70*a*.

However, the elastic part 88*b* deforms into such a shape that it does not disrupt the rotation of the first detection part 82 (or the tip member 82*b*) when the entire paper detection part 80 is subjected to pressure (inertia of the paper detection part 80) which allows the first detection part 82 to return from the paper through position to the reference position. As a result, the first detection part 82 (or the tip member 82*b*) gets free from the elastic part 88*b* and rotates from the paper-through position to the reference position. Namely, the lock of the posture of the tip member 82*b* is released.

According to the second embodiment, since the tip member 82*b* is locked when rotating from the reference position by an angle of a predetermined degrees or more, it is possible to prevent the posture of the paper being discharged from the discharge opening 70*a* from being disturbed and thus prevent the paper stacking characteristics from being deteriorated.

In each of the above described embodiments, although the image forming apparatus 10 is configured as a color multifunction machine, the image forming apparatus according to the present invention may be configured as a monochrome printing machine or a monochrome multifunction machine.

In each of the above described embodiments, although the image forming apparatus 10 is configured as a multifunction machine, the image forming apparatus according to the present invention may be configured as a printer, a copier, or a facsimile if including even the paper discharging tray.

Furthermore, it should be noted that the specific shapes and the like given in the above-described embodiments are only examples, and they can be changed or modified as appropriate depending on actual products.

What is claimed is:

1. An image forming apparatus comprising:

an image forming device to form an image on a sheet;

a discharge opening for discharging the sheet on which the image is printed by the image forming device;

a paper discharging tray on which the sheet discharged from the discharge opening is placed;

a paper discharging roller provided on an upstream side of a sheet discharge direction from the discharge opening;

a base end member provided at the discharge opening, and the base end member being rotatable around a first axis extending in a direction perpendicular to the sheet discharge direction;

a tip member pivoted to the base end member to rotate around a second axis parallel to the first axis, the tip member extending downwardly to incline toward the upstream side of the sheet discharge direction in a state where the base end member is not subjected to pressure from the sheet being discharged, and the tip member coming into contact with the sheet when a height of a top surface of the sheet stacked on the paper discharging tray exceeds a predetermined height;

a determiner to determine whether the base end member rotates by a predetermined threshold or more with respect to a reference position when no sheet is discharged; and a stopper to stop discharging the sheet from the discharge opening by stopping operation of the paper discharging roller at least, in response that the determiner determines that the base end member rotates by the predetermined threshold or more with respect to the reference position, wherein the base end member is disposed to face the discharge opening when being at the reference position, and the base end member and the tip member respectively rotate in response to the pressure from the sheet being discharged from the discharge opening.

2. The image forming apparatus according to claim 1 further comprising a first forcing member to force the tip member around the second axis and toward the upstream side of the sheet discharge direction.

3. The image forming apparatus according to claim 2, wherein when the tip member is at the reference position, a tip of the tip member is positioned at an upstream side with respect to the discharge opening in the sheet discharge direction.

4. The image forming apparatus according to claim 3, wherein the paper discharging tray includes a vertical wall surface that is formed at the upstream side with respect to the discharge opening in the sheet discharge direction, and when the tip member is at the reference position, the tip of the tip member abuts on the vertical wall surface.

5. The image forming apparatus according to claim 1 further comprising a second forcing member to force the base end member around the first axis and toward the upstream side of the sheet discharge direction.

6. The image forming apparatus according to claim 1 further comprising a lock device that locks a posture of the tip member when the tip member is rotated by the pressure from the sheet being discharged from the discharge opening by an angle of a predetermined degrees or more.

7. The image forming apparatus according to claim 6, wherein the lock device releases the lock of the posture of the tip member when the base end member returns to the reference position.

8. The image forming apparatus according to claim 1 further comprising an auxiliary member provided at an end of the discharge opening in a sheet width direction, the auxiliary member being rotatable around the first axis working with the base end member, and the auxiliary member coming into contact with the sheet when the height of the top surface of the sheet stacked on the paper discharging tray exceeds the predetermined height.

* * * * *